US011236875B2

(12) United States Patent
Chen et al.

(10) Patent No.: US 11,236,875 B2
(45) Date of Patent: Feb. 1, 2022

(54) SMART STREET LAMP

(71) Applicants: Shanghai Sansi Electronic Engineering Co., Ltd., Shanghai (CN); Sansi Optoelectronics Technology (Shanghai) Co., Ltd., Shanghai (CN); Shanghai Sansi Technology Co., Ltd., Shanghai (CN); Jiashan Sansi Optoelectronic Technology Co., Ltd., Jiaxing (CN)

(72) Inventors: Bishou Chen, Shanghai (CN); Yuxi Jiang, Shanghai (CN); Qian Zhang, Shanghai (CN); Yingqi Li, Shanghai (CN)

(73) Assignees: Shanghai Sansi Electronic Engineering Co. Ltd., Shanghai (CN); Sansi Optoelectronics Technology (Shanghai) Co. Ltd., Shanghai (CN); Shanghai Sansi Technology Co. Ltd., Shanghai (CN); Jiashan Sansi Optoelectronic Technology Co., Ltd., Jiaxing (CN)

( * ) Notice: Subject to any disclaimer, the term of this patent is extended or adjusted under 35 U.S.C. 154(b) by 0 days.

(21) Appl. No.: 16/757,772

(22) PCT Filed: Jul. 25, 2018

(86) PCT No.: PCT/CN2018/096991
§ 371 (c)(1),
(2) Date: Apr. 21, 2020

(87) PCT Pub. No.: WO2020/000550
PCT Pub. Date: Jan. 2, 2020

(65) Prior Publication Data

US 2021/0172575 A1 Jun. 10, 2021

(30) Foreign Application Priority Data

Jun. 29, 2018 (CN) ..... 201810700749.5
Jun. 29, 2018 (CN) ..... 201821029522.4

(51) Int. Cl.
*F21S 8/08* (2006.01)

(52) U.S. Cl.
CPC ..... *F21S 8/088* (2013.01); *F21S 8/085* (2013.01)

(58) Field of Classification Search
CPC .... F21S 8/08; F21S 8/085; F21S 8/086; F21S 8/088; Y02B 20/72; G07C 2009/00769; G07C 2009/00753; G07C 9/00174
See application file for complete search history.

(56) References Cited

U.S. PATENT DOCUMENTS 4,749,359 A * 6/1988 White ..... H01R 13/44 174/60
4,790,434 A * 12/1988 Schoberg ..... G11B 23/0236 190/110

(Continued)

FOREIGN PATENT DOCUMENTS

CN 102200262 A 9/2011
CN 204463447 U 7/2015

(Continued)

OTHER PUBLICATIONS

Doyama, Ybrid Generation-Type Streetlamp, Feb. 21, 2013, WO-2013024515-A1 (Year: 2013).*

*Primary Examiner* — Jong-Suk (James) Lee
*Assistant Examiner* — James M Endo

(57) ABSTRACT

The present disclosure relates to a smart street lamp, including: a lamppost, having at least one accommodating portion therein; and at least one equipment box, detachably placed in the accommodating portion. The equipment box is detach- (Continued)

ably mounted on the lamp pole for convenient transportation. Further, the equipment box can also be protected by the anti-theft security mechanism to enhance the anti-theft performance of the smart street lamp.

15 Claims, 5 Drawing Sheets

(56) References Cited

U.S. PATENT DOCUMENTS 5,581,958 A * 12/1996 Cote ..... H01Q 1/1242 343/720
6,359,836 B1 * 3/2002 Sevier ..... G11B 33/08 174/50
7,219,873 B2 * 5/2007 Harwood ..... E04H 12/2261 181/171
2005/0174762 A1 * 8/2005 Fogerlie ..... F21S 8/086 362/183
2007/0164848 A1 * 7/2007 Kim ..... G07C 9/00174 340/5.73
2008/0035035 A1 * 2/2008 Stone ..... F25D 23/12 109/1 R
2008/0298762 A1 * 12/2008 Hawley ..... H04Q 1/064 385/135
2009/0154178 A1 * 6/2009 Hall ..... E04H 12/003 362/431
2009/0237918 A1 9/2009 Yang
2010/0220467 A1 * 9/2010 Daidone ..... F21S 9/026 362/183
2014/0352368 A1 * 12/2014 Ridenour ..... F21S 8/085 70/2
2017/0122546 A1 * 5/2017 Abbott ..... F21V 33/00
2017/0164773 A1 * 6/2017 Wirtz ..... A47G 29/30

FOREIGN PATENT DOCUMENTS

CN 206459121 U 9/2017
CN 107366881 A 11/2017
CN 206686425 U 11/2017
WO WO-2013024515 A1 * 2/2013 ..... F21S 9/026

* cited by examiner

SMART STREET LAMP

CROSS REFERENCE TO RELATED APPLICATION

This is a Sect. 371 National Stage of PCT International Application No. PCT/CN2018/096991, filed on 25 Jul. 2018, which claims priority of a Chinese Patent Application No. 2018107007495 filed on 29 Jun. 2018, and a Chinese Patent Application No. 2018210295224 filed on 29 Jun. 2018, the contents of both applications hereby being incorporated by reference in their entireties for all purposes.

BACKGROUND

Field of Disclosure

The present disclosure relates to a lighting device, in particular, to a smart street lamp.

Description of Related Arts

Smart street lamps have been used for civilian use. The lampposts of smart street lamps and the equipment boxes for accommodating the internal electronic and electrical components of smart street lamps are integrally formed.

Thus, if smart street lamps need to be sold to countries far away, such as South Africa, the United States, South America, etc., the transportation cost will be very high. In addition, the equipment boxes of smart street lamps are often very large, and the transportation space and cost are also issues that need to be considered at present.

Therefore, how to solve the current difficulties, reduce transportation costs, and reduce financial and material resources is a technical problem to be solved urgently in the industry.

SUMMARY OF THE PRESENT DISCLOSURE

The present disclosure provides a smart street lamp for solving the problems.

The present disclosure provides a smart street lamp, including: a lamppost and at least one equipment box. At least one accommodating portion is placed in the lamppost; and at least one equipment box, detachably placed in the accommodating portion.

In an embodiment of the present disclosure, a number of the equipment box is at least two, the equipment box includes: an electric box to load a strong current circuit, and an electronic box to load a weak current circuit.

In an embodiment of the present disclosure, a number of the equipment box is one, and at least two sub-equipment boxes are placed in the equipment box, including: an electric box to load a strong current circuit, and an electronic box to load a weak current circuit.

In an embodiment of the present disclosure, the electric box includes: one or a combination of an alternating current (AC) distribution circuit, a direct current (DC) distribution circuit, an alternating current and direct current conversion circuit, a light source driver, one or more sensors, an electrical wiring, and a fiber optic box.

In an embodiment of the present disclosure, the electronic box includes: one or more combinations of a network communication module, a call extension module, a sensor access point module, one or more sensors, a controller, an electrical wiring and a network wiring.

In an embodiment of the present disclosure, the network communication module includes: an Ethernet communication module and/or an Internet of Things communication module. The network communication module communicates with an external control platform. The network communication module is controlled by the external control platform and/or sends operating status information of the smart street lamp.

In an embodiment of the present disclosure, the one or more sensors include: one or a combination of a door state sensor, a temperature and humidity sensor, a smoke sensor, a water immersion sensor, and a lamppost state sensor.

In an embodiment of the present disclosure, the one or more sensors include: one or a combination of a door switch sensor, a temperature and humidity sensor, a smoke sensor, and a water immersion sensor.

In an embodiment of the present disclosure, the equipment box contains at least one box locking device; the box locking device comprises: a lock body; and a locking mechanism connected in linkage with the lock body, moving to a first position engaged with the lamppost to lock the equipment box in the accommodating portion when the lock body is in a locked state; or moving to a second position disengaged from the lamppost to unlock the equipment box and thus being taken away from the lamppost when the lock body is in an unlocked state.

In an embodiment of the present disclosure, the locking mechanism includes: a stopper that is movable to extend outside the equipment box to block against an inner wall of the lamppost.

In an embodiment of the present disclosure, the lock body includes: a mechanical lock, locking the equipment box to the lamppost when the mechanical lock is in a locked state; or unlocking the locking mechanism when the mechanical lock is in an unlocked state.

In an embodiment of the present disclosure, the lock body includes: a mechanical lock and an electronic lock. The locking mechanism is unlocked only when the mechanical lock and the electronic lock are both in an unlocked state.

In an embodiment of the present disclosure, the electronic lock is locked or unlocked according to an electronic control command. The electronic control command is generated according to an identity verification result of a person operating the box locking device.

In an embodiment of the present disclosure, the equipment box includes: a box lock state sensor, an identity information collecting device and a controller placed at the box locking device; the box lock state sensor detects signals generated by the box locking device when the box locking device is being operated; the controller is communicably connected with the box lock state sensor and the identity information collecting device, the controller acquires identity information of a person performing the operation by the identity information collecting device when receiving the signal; The identity information is configured to authenticate the identity of the person performing the operation, thereby generating the electronic control command sent to the electronic lock 505 based on the identity verification result.

In an embodiment of the present disclosure, a plurality of box locking devices is respectively located at at least two sides of the equipment box in different directions.

In an embodiment of the present disclosure, the equipment box includes: a box door and a box door locking device; the box door locking device includes an electronic lock, the electronic lock locks or unlocks the box door according to an electronic control command, and the electronic control command is generated according to an identity verification result of a person operating the box door.

In an embodiment of the present disclosure, the equipment box includes: a box door state sensor, an identity information collecting device and a controller; the box door state sensor detects signals generated by the box door when the box door is being operated; the controller is communicably connected with the box door state sensor and the identity information collecting device, the controller acquires identity information of a person performing the operation by the identity information collecting device when receiving the signal; The identity information is configured to authenticate the identity of the person performing the operation, thereby generating the electronic control command sent to the electronic lock 505 based on the identity verification result.

In an embodiment of the present disclosure, the identity information collecting device includes: one or more of an image collecting device, a sound collecting device, a password collecting device, a biological information collecting device, and a document information extracting device.

In an embodiment of the present disclosure, the smart street lamp includes: an alarm device, performing an alarm when receiving an alarm command indicating that the identity verification result is a failure; the alarm device includes: one or a combination of an audio player, a display screen of the smart street lamp, and a lighting source of the smart street lamp; The alarm includes: one or a combination of playing an alarm audio through the audio player, playing an alarm image through the display screen, and performing lighting by the lighting source according to a preset alarm lighting parameter.

As described above, the present disclosure provides a smart street lamp, including: a lamppost and at least one equipment box. At least one accommodating portion is placed in the lamppost; and the at least one equipment box is detachably placed in the accommodating portion. The equipment box is detachably mounted on the lamp pole for convenient transportation. Further, the equipment box can also be protected by the anti-theft security mechanism to enhance the anti-theft performance of the smart street lamp.

DETAILED DESCRIPTION OF THE PREFERRED EMBODIMENTS

Figure 1A:
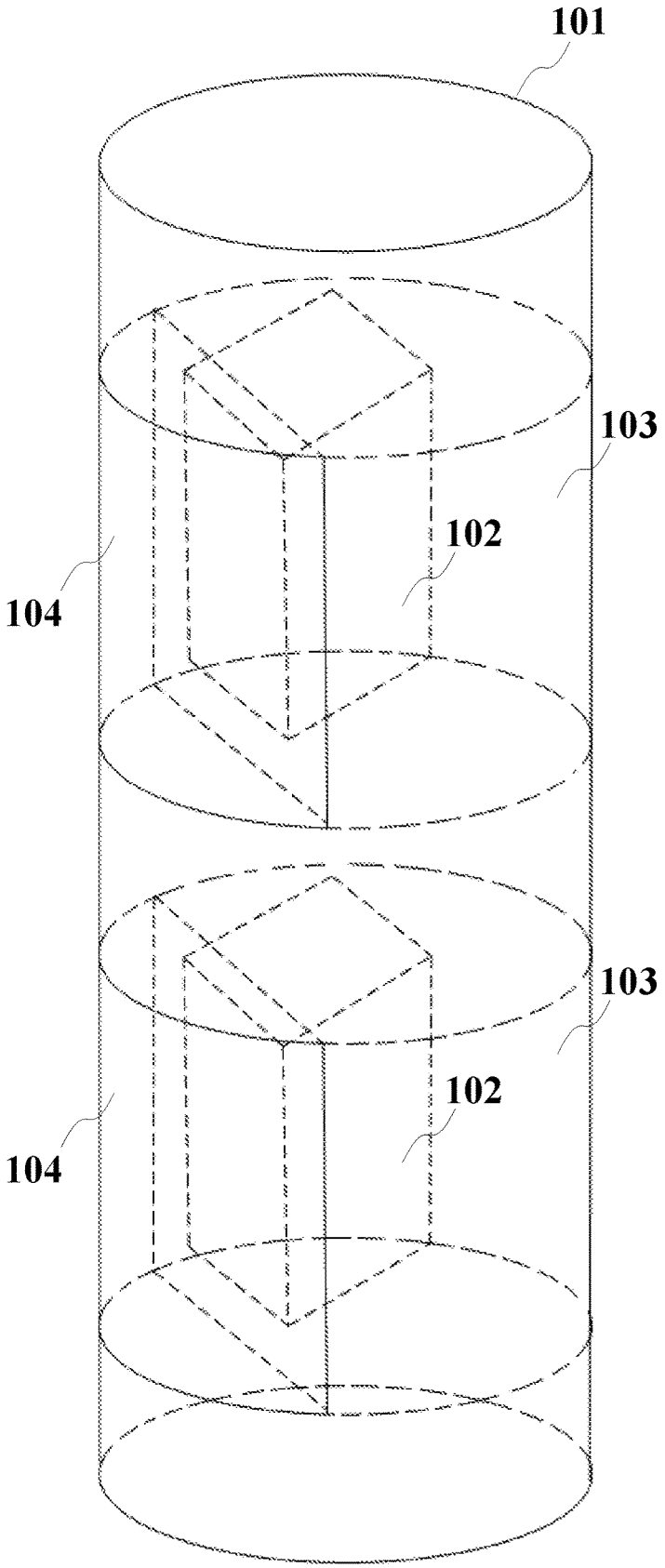
FIG. 1A is a schematic diagram showing a partial structure of a smart street lamp according to an embodiment of the present disclosure.

The embodiments of the present disclosure will be described below. Those skilled may easily understand other advantages and effects of the present disclosure according to contents disclosed by the specification.

Referring to the figures. It should be understood that the structures, proportions, sizes, and the like, which are illustrated in the drawings of the present specification, are only configured to clarify the contents disclosed in the specification for understanding and reading by those skilled, and are not intended to limit the implementation of the present disclosure, thus are not technically meaningful. Any modification of the structure, change of the scale, or adjustment of the size should still fall within the scope of the technical contents disclosed by the present disclosure without affecting the effects and achievable objectives of the present disclosure. In the meantime, the terms "upper", "lower", "left", "right", "intermediate" and "one" as used in this specification are also for convenience of description, and are not intended to limit the scope of the present disclosure, and the change or adjustment of the relative relationship is considered to be within the scope of the present disclosure without substantial changes in technology.

The technical solution of the present disclosure is applied to a smart street lamp, and the installation structure of the equipment box in the smart street lamp is improved.

FIG. 1A is a schematic diagram showing the partial structure of the smart street lamp according to an embodiment of the present disclosure.

The smart street lamp includes: a lamppost 101 and at least one equipment box 102.

The lamppost 101 is hollow inside, and at least one accommodating portion 103 is formed, the number of the accommodating portion 103 corresponds to the number of the equipment boxes 102. In this embodiment, two equipment boxes 102 and two corresponding accommodating portions 103 are shown. The equipment boxes 102 are placed in the accommodating portion 103 in one-to-one correspondence. Of course, in other embodiments, the number is not limited.

In an embodiment of the present disclosure, the accommodating portion 103 is formed in the inner space of the lamppost 101, and has an opening on the side wall of the lamppost 101 for access of the equipment box 102. A positioning structure for positioning the equipment box 102 may be placed inside the accommodating portion 103, for example, one or more strips, baffles, etc. protruding from the inner wall of the lamppost 101 for carrying the equipment box 102, or one or more protrusions or recesses, etc., which are engaged with the recesses or protrusions of the equipment box 102. Of course, this positioning structure is not necessary.

The equipment box 102 is detachably placed in the accommodating portion 103. In an embodiment of the present disclosure, the detachable manner may be a screw-locking manner. The equipment box 102 is placed behind the accommodating portion 103, and the equipment box 102 may be fixed in the accommodating portion 103 by means of a screw-locking. For example, the lamppost 101 contains an opening, the equipment box 102 contains a screw hole aligned with the opening, and the screw is fixedly coupled with the screw hole through the opening of the lamppost 101, thereby fixing the equipment box 102 in the accommodating portion 103.

The shell of the equipment box 102 may be made of anti-collision material, such as impact resistant metal (such as steel plate), alloy, etc. Alternatively, the shell of the equipment box 102 may be made of a composite material, such as carbon fiber material, polycarbonate (PC), polypropylene (PP), acrylonitrile-butadiene-styrene copolymer (ABS), and high-density polyethylene (HDPE), etc. The shell of the equipment box 102 may be designed with impact resistant structure, and/or the impact resistant structure pad, to further enhance the anti-collision performance.

The power distribution in the smart street lamp has AC power access and the output of the converted DC power. The AC power is generally 380V/220V, and the converted DC power is 48V or 12V, etc. However, some intelligent functions inside the smart street lamp, such as the network communication module (such as Ethernet switch module, Internet of Things gateway module, etc.), the data processing circuit, network cable and lighting source control, etc., use lower voltage for power supply and signal transmission, such as 3V, 5V, etc.

In an embodiment of the present disclosure, a number of the equipment boxes 102 is at least two. The equipment box includes: an electric box to load a strong current circuit, and an electronic box to load a weak current circuit. In other embodiments, the number of the strong electric boxes and the weak electronic boxes may be arbitrarily set.

Figure 1B:
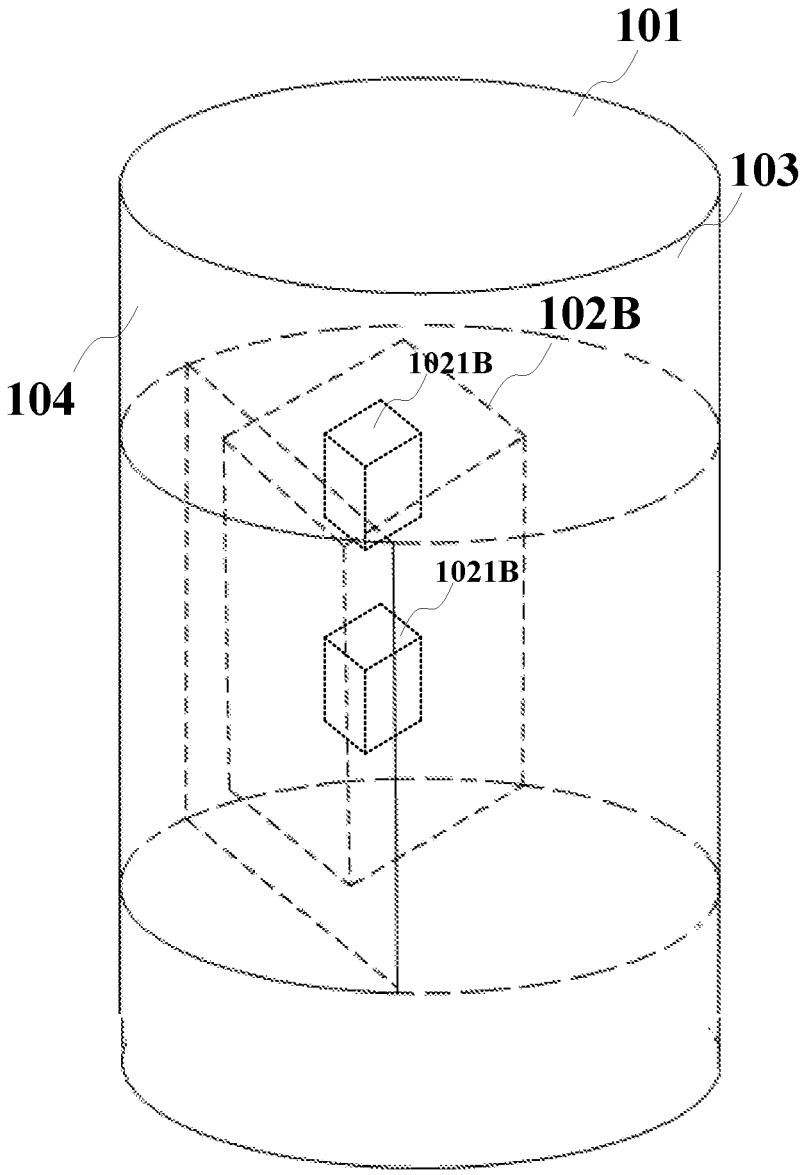
FIG. 1B is a schematic diagram showing the partial structure of the smart street lamp according to another embodiment of the present disclosure.

As shown in FIG. 1B, in an embodiment of the present disclosure, a number of the equipment box 102B is one. At least two sub-equipment boxes 1021B are placed in the equipment box. The sub-equipment box 1021B includes: the electric box to load a strong current circuit, and the electronic box to load a weak current circuit. The number of the electric boxes and the electronic boxes may be arbitrarily set.

In the present disclosure, the equipment box 102 and the lamppost 101 are detachably placed. In order to prevent the equipment box 102 from being stolen, the equipment box 102 includes at least one box locking device for locking the equipment box 102 in the accommodating portion 103 in the lamppost 101.

The box locking device includes: a lock body and a locking mechanism.

The lock body may include a mechanical lock and/or an electronic lock. The mechanical lock may be locked or unlocked by turning a key. The electronic lock may be locked or unlocked by an electronic control signal.

The locking mechanism is connected in linkage with the lock body. When the lock body is in a locked state, the locking mechanism moves to a first position engaged with the lamppost 101 to lock the equipment box 102 in the accommodating portion 103. When the lock body is in an unlocked state, the locking mechanism moves to a second position disengaged from the lamppost 101 to unlock the equipment box 102, the equipment box 102 therefore can be taken away from the lamppost 101.

Figure 2A:
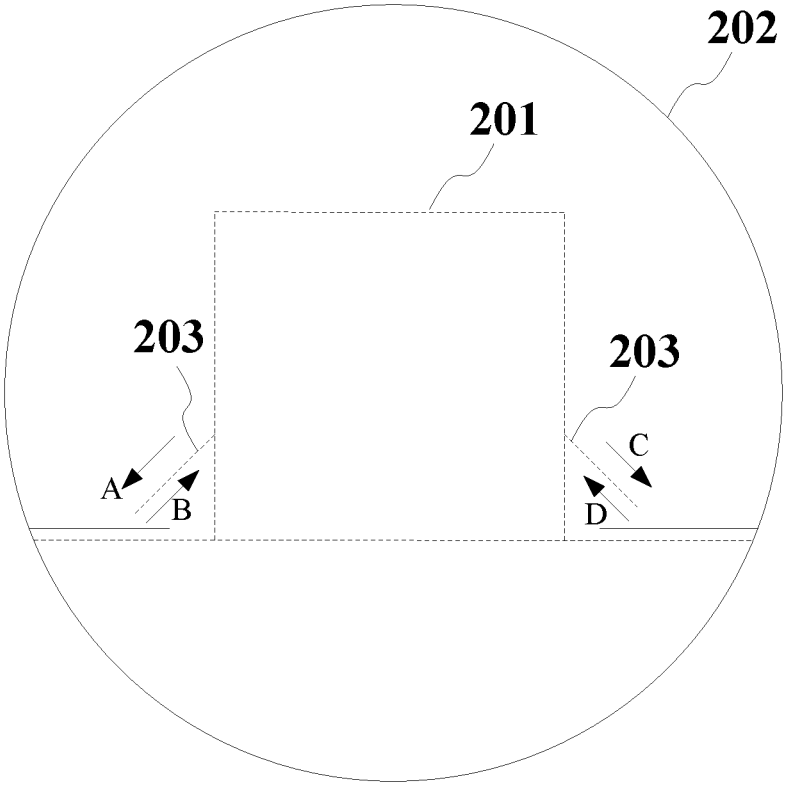
FIG. 2A is a schematic diagram showing a plan view of an equipment box locked to a lamppost according to an embodiment of the present disclosure.
Figure 2B:
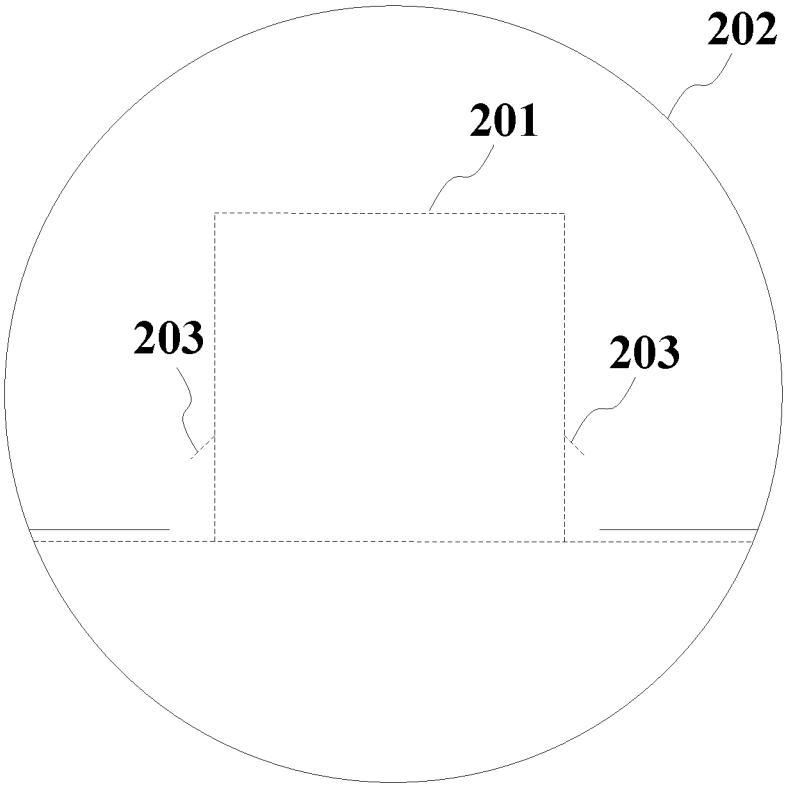
FIG. 2B is a schematic diagram showing a plan view of the equipment box unlocked to the lamppost according to an embodiment of the present disclosure.

Specifically, as shown in FIGS. 2A and 2B, the locking mechanism includes: two stoppers 203 which are movable to extend outside the equipment box 201 to block against an inner wall of the lamppost 202. The locking mechanism may move with the change of the locking and unlocking state of the lock body, one stopper telescopically moves along the A direction or the B direction, and the other stopper telescopically moves along the C direction or the D direction.

In FIG. 2A, the locking mechanism enters the locked state with the lock body. The stopper 203 moves along the A direction to block against the inner wall of the lamppost 202. More specifically, the stopper 203 protrudes from the equipment box 201 to block against the inner walls adjacent to the opening of the lamppost 202. Therefore, the equipment box 201 is blocked by the inner wall of the lamppost 202 and cannot be taken out. In this state, even if the equipment box 201 is exposed to the lamppost 202, there is no way to take out the entire equipment box 201.

In FIG. 2B, the locking mechanism enters the unlocked state with the lock body. The stopper 203 moves along the B direction until it is separated from the inner wall of the lamppost 202. Specifically, the stopper 203 retracts to the equipment box 201 and no longer blocks against the inner wall of the lamppost 202. In this state, the equipment box 201 may be removed from the lamppost 202. As described above, at this time, the equipment box 201 may be fixed to the lamppost 202 by screwing, and the equipment box 201 may be removed by screwing off the screw.

In an embodiment of the present disclosure, the lock body includes: a mechanical lock, which may drive the locking mechanism to lock or unlock the equipment box in the lamppost only by locking or unlocking the mechanical lock. Specifically, when the mechanical lock is in the locked state, the equipment box is locked to the lamppost, that is, for example, the stopper of the locking mechanism protrudes from the equipment box to abut against the inner wall of the lamppost. Alternatively, when the mechanical lock is in the unlocked state, the locking mechanism is unlocked, that is, the stopper of the locking mechanism retracts to the equipment box and no longer abuts against the inner wall of the lamppost.

In another embodiment of the present disclosure, the lock body includes: a mechanical lock and an electronic lock. The locking mechanism is unlocked only when the mechanical lock and the electronic lock are both in an unlocked state. Specifically, the locking mechanism cannot be unlocked by unlocking the mechanical lock or the electronic lock.

In a specific implementation, the first lock of the mechanical lock and the electronic lock is connected to the locking mechanism, the second lock thereof is configured to lock the locking mechanism or the additional locking mechanism of the first lock. After unlocking the locking mechanism or the additional locking mechanism of the first lock by unlocking the second lock, the locking of the locking mechanism to the equipment box may be released by unlocking the first lock.

For example, the mechanical lock is connected with the locking mechanism, and the electronic lock is connected with the additional locking mechanism locked on the locking mechanism. When the additional locking mechanism is not unlocked, the locking mechanism cannot be unlocked by the mechanical lock. After the electronic lock is unlocked first to release the locking of the locking mechanism by the additional locking mechanism, the mechanical lock can be unlocked by the key to unlock the locking of the equipment box by the locking mechanism.

In an embodiment of the present disclosure, the electronic lock is locked or unlocked according to an electronic control command. The electronic control command is generated according to an identity verification result of a person operating the box locking device.

Figure 3:
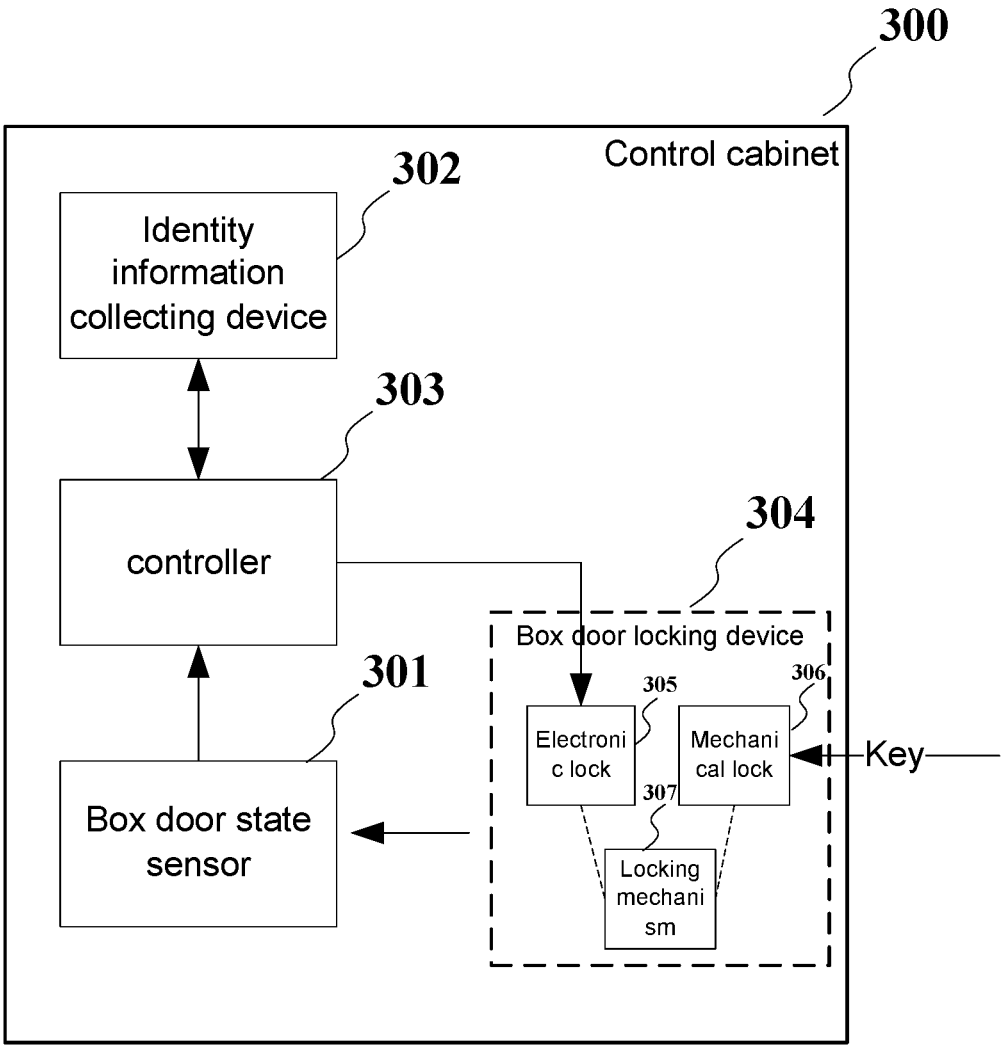
FIG. 3 is a schematic diagram of functional modules for implementing unlocking a box locking device according to an embodiment of the present disclosure.

FIG. 3 is a schematic diagram of functional modules showing the principle of unlocking a box locking device in the embodiment.

Specifically, the equipment box 300 includes: a box lock state sensor 301, an identity information collecting device 302 and a controller 303 placed at the box locking device 304.

The box lock state sensor 301 detects signals generated by the box locking device 304 when the box locking device is being operated. In an embodiment of the present disclosure, the operation includes, for example, that a key is turned or inserted to unlocked the mechanical lock 306. The box lock state sensor 301 may be a position sensor, a pressure sensor, a magnetic sensor or a vibration sensor, etc. The box lock state sensor 301 may be implemented in many ways, and only needs to be able to detect that the box locking device 304 is operated, which is not enumerated here.

The controller 303 is communicably connected with the box lock state sensor 301 and the identity information collecting device 302. The controller 303 acquires identity information of a person performing the operation by the identity information collecting device 302 when receiving the signal. The identity information is configured to authenticate the identity of the person performing the operation, thereby generating the electronic control command sent to the electronic lock 305 based on the identity verification result.

In an embodiment of the present disclosure, the controller 303 may include a processing component having data processing capabilities. The processing component may be a processor such as a CPU, MCU, SoC, FPGA, PLC, CPLD, or DSP, etc. The function is implemented by executing a program.

In an embodiment of the present disclosure, the identity information collecting device 302 includes: one or more of an image collecting device, a sound collecting device, a password collecting device, a biological information collecting device, and a document information extracting device. For example, the image collecting device includes: a camera, etc. The sound collecting device includes: a pickup (such as a microphone), etc. The password collecting device includes: a display screen displaying a human-computer interaction interface, and an input device (such as a physical or graphic keyboard, etc.) for inputting a password on the human-computer interaction interface. The biological information collecting device collects biological information of a human body. The biological information includes: facial information, human body information (fingerprint, palm print, iris, vein, sweat, or DNA, etc.) and the corresponding collector, such as an image collector, a fingerprint collector, a saliva collector, or a palm print collector, etc. The document information extracting device includes: one or more of an RFID reader, a camera, a bar-code scanner, etc. for reading information in a paper such as an RFID card, an ID card, a driver's license, a bar-code, a QR code, or a bank card, etc.

The identity authentication means that the collected identity information is matched with the pre-stored information. The verification succeeds if the matching succeeds, and the generated electronic control command may unlock the electronic lock 305. If the matching fails, the verification fails. The correspondingly generated electronic control command (if no instruction is generated, it is equivalent to sending an empty electronic control command) cannot unlock the electronic lock 305.

In one or more embodiments of the present disclosure, the action of the identity authentication and the generation of the corresponding electronic control command may be completed by the processing component integrated in the identity information collecting device 302, or may be completed by the controller 303, or may be completed by an external control platform, the external control platform receive information from the network communication module communicatively connected with the controller 303.

For example, the identity information collecting device 302 includes: a camera that collects the face image of a person operating the lock body of the box locking device 304. The controller 303 sends the face image to the external control platform through the connected network communication module, and the control platform identifies according to the face image. If the person is recognized as a legal person (for example, a registered worker, or a staff with the corresponding authority), the authentication succeeds. The identity authentication result is fed back to the network communication module and reaches the controller 303. The controller 303 generates an electronic control command to the electronic lock 305 of the box locking device 304 to unlock the electronic lock 305, in combination with the unlocking of the mechanical lock 306 by the key, the locking mechanism 307 is driven to unlock the equipment box 300, thereby making the equipment box 300 detachable.

In an embodiment of the present disclosure, a plurality of box locking devices is respectively located at at least two sides of the equipment box in different directions.

In one or more embodiments of the present disclosure, there may be multiple box locking devices to enhance safety.

Figure 4:
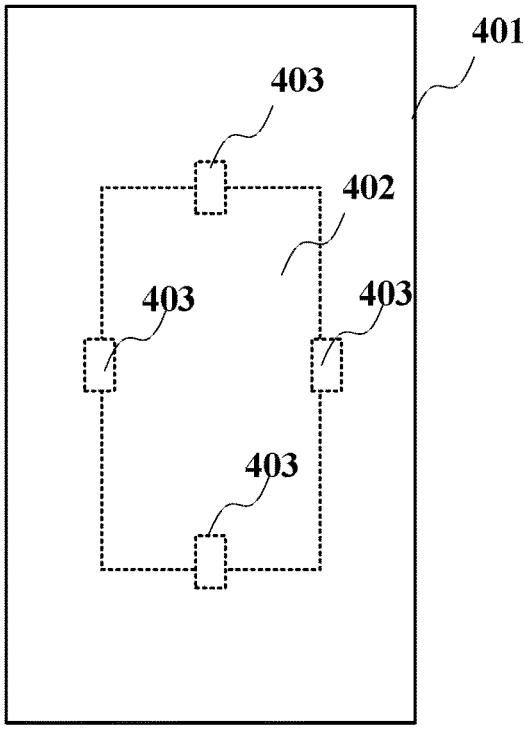
FIG. 4 is a schematic diagram showing a plan view of a plurality of box locking devices according to an embodiment of the present disclosure.

As shown in FIG. 4, in this embodiment, there are four box locking devices 403, which are respectively located in the upper, lower, left and right directions of the equipment box 402 in the lamppost 401. Each box locking device 403 may have a separate lock body and locking mechanism (as shown in FIGS. 2A and 2B). The equipment box 402 may be removed from the lamppost 401 only if the four box locking devices 403 are unlocked. In the figure, it is conceptually marked the position of the lock body to represent the box locking device 403, it does not mean that the locking mechanism is not set.

Of course, the number of the box locking devices in this embodiment is only an example, and may be changed according to actual conditions, and is not limited to this embodiment.

As shown in FIG. 1, the equipment box 102 further includes a box door 104 for protecting components inside the equipment box 102, such as an electric circuit, a lock body of the box locking device (not shown in FIG. 1), etc. That is, the box locking device in the equipment box 102 cannot be operated without the box door 104 being opened.

Preferably, the box door 104 together with the surface of the lamppost form a smooth surface, such as a flat surface or a curved surface, which is artistic.

The box door 104 may contain a box door locking device (not shown in FIG. 1). The box door locking device includes an electronic lock, to lock or unlock the box door 104 according to an electronic control command. The electronic control command is generated according to an identity verification result of a person operating the box door 104.

Figure 5:
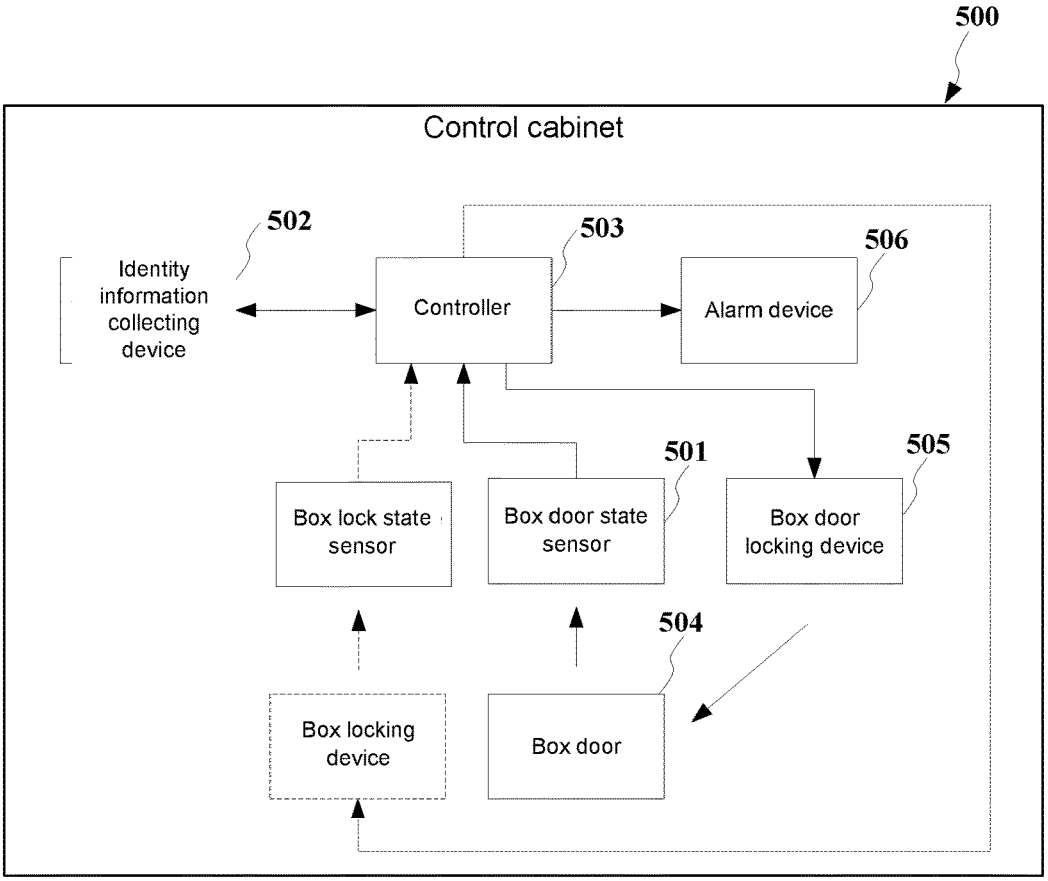
FIG. 5 is a schematic diagram of functional modules for implementing unlocking a box door locking device according to an embodiment of the present disclosure.

FIG. 5 is a schematic diagram of functional modules showing the principle of unlocking the box door locking device in the embodiment. Specifically, the equipment box includes: a box door state sensor 501, an identity information collecting device 502, and a controller 503.

In this embodiment, preferably, the identity information collecting device 502 and/or the controller 503 are the same units as the identity information collecting device 302 and the controller 303 in the foregoing embodiment, thereby achieving higher device utilization and circuit integration. Thus, the embodiment of FIG. 3 may be implemented in the embodiment of FIG. 5, as indicated by the dashed lines shown in FIGS. 3 and 5.

The box door state sensor 501 detects signals generated by the box door locking device 505 when the box door locking device 505 is being operated. In an embodiment of the present disclosure, the operation is, for example, attempting to open the box door 504, scanning the QR code on the box door 504, etc. The box lock state sensor 501 may be a position sensor, a pressure sensor, a magnetic sensor or a vibration sensor, etc. The box lock state sensor 501 may be implemented in many ways, and only needs to be able to detect that the box door is operated, which is not enumerated here.

The controller 503 is communicably connected with the box door state sensor 501 and the identity information collecting device 502. The controller 503 acquires identity information of a person performing the operation by the identity information collecting device 502 when receiving the signal. The identity information is configured to authenticate the identity of the person performing the operation, thereby generating the electronic control command sent to the electronic lock 505 based on the identity verification result.

In one or more embodiments of the present disclosure, the action of the identity authentication and the generation of the corresponding electronic control command may be completed by the processing component integrated in the identity information collecting device 502, or may be completed by the controller 503, or may be completed by an external control platform, the external control platform receive information from the network communication module communicatively connected with the controller 503.

For example, the identity information collecting device 502 includes: a camera that collects the face image of a person operating the box door 504. The controller 503 sends the face image to the external control platform through the connected network communication module, and the control platform identifies according to the face image. If the person is recognized as a legal person (for example, a registered worker, or a staff with the corresponding authority), the authentication succeeds. The identity authentication result is fed back to the network communication module and reaches the controller 503. The controller 503 generates an electronic control command to the box door locking device 505 to unlock it, thereby opening the box door.

In an embodiment of the present disclosure, the smart street lamp further includes: an alarm device 506. The alarm device 506 gives an alarm when receiving an alarm command indicating that the identity verification result is a failure. The alarm device 506 includes: one or a combination of an audio player, a display screen of the smart street lamp, and a lighting source of the smart street lamp. The alarm includes: one or a combination of playing an alarm audio through the audio player, playing an alarm image through the display screen, and performing lighting by the lighting source according to a preset alarm lighting parameter.

For example, the controller 503 may authenticate the identity of the person attempting to open the box door. When the identity verification result is a failure, it is determined that the person is an illegal person, and the box door locking device 505 is reconfigured to be unlocked. Furthermore, the alarm is performed by controlling the light source module of the smart street lamp to emit, for example, blinking red light, and/or, for example, an image of "illegal encroachment" may be displayed through the display screen of the smart street lamp.

Further, the circuit layout in the electric box and the electronic box is described by an exemplary embodiment.

Specifically, the electric box includes: one or a combination of an AC distribution circuit (which may include a leakage protector, a surge protection circuit), a DC distribution circuit (such as a 48 VAC-DC power supply, a 12 VAC-DC power supply), an AC/DC conversion circuit, a light source driver (if the smart street lamp is an LED light source, it may be an LED constant current driver, a PLC single lamp controller), one or more first sensors, electrical wiring, and a fiber optic box.

In an embodiment of the present disclosure, the one or more first lamppost state sensors include a water immersion sensor for detecting whether water is in the electric box. The water immersion sensor is based on the principle of liquid conductivity and uses electrodes to detect the presence of water. The one or more sensors may further include a leakage sensor for collecting leakage current.

Preferably, the first sensor is a wireless sensor. The first sensor sends collected data to the outside. The collected data include a water immersion electric signal collected by a water immersion sensor, an electric signal of a leakage current collected by the leakage sensor. The first sensor is accessed to the external network (for example, an Internet of Things, such as NB-IOT, ZigBee, LoRa, or an Ethernet network) through wireless communication mode to perform signal transmission, such as transmission to a control platform, etc.

Specifically, the electronic box includes: one or a combination of a network communication module, a call extension module, a sensor access point module, one or more second sensors, a controller, an electrical wiring and a network wiring.

In an embodiment of the present disclosure, the network communication module includes: an Ethernet communication module and/or an Internet of Things communication module. The network communication module communicates with an external control platform. The network communication module is controlled by the external control platform and/or sends operating status information of the smart street lamp. Specifically, the Ethernet communication module includes, for example, a WiFi module, a wired network card, or an Ethernet switch. The Internet of Things communication module is a module such as NB-IOT, Zigbee, Lora.

In an embodiment of the present disclosure, the one or more second sensors include: one or more combinations of a door state sensor, a temperature and humidity sensor, a smoke sensor, and a lamppost state sensor.

Specifically, the temperature and humidity sensor collects the temperature and humidity in the equipment box, and may transmit the information to the controller or an external control platform. The controller or an external control platform determines whether the device in the equipment box is in a safe environment according to whether the collected temperature and/or humidity signal exceeds a threshold. If the threshold is exceeded, it means that the device is easily damaged and the equipment box needs to be maintained. The smoke sensor may detect whether the equipment box is on fire. The lamp pole state sensor is, for example, a tilt sensor for detecting whether the smart street lamp is damaged, such as tilting or dumping.

In an embodiment of the present disclosure, the sensor access point module may be a wireless node. Each of the second lamppost state sensors may be a wireless sensor and is in communication with the sensor access node. Preferably, the first lamppost state sensor in the electric box may be a wireless sensor, and may transmit the collected data to the sensor access point module, thereby transmitting the collected data by interacting with the control platform through the network communication module in the electronic box.

It should be noted that the layout of the components in the electronic box and the electric box in the above embodiment is only an example, and the type selection of the sensor is also an example, and is not limited thereto.

For example, a network communication module may be placed in the electric box, to communicatively connect with the control platform to transmit the leakage current information to the outside to alarm.

For another example, the one or more first sensors may also include: one or more combinations of a door switch sensor, a temperature sensor, a humidity sensor, a temperature and humidity sensor, a smoke sensor, and a water immersion sensor. Not limited to the above.

In summary, the present disclosure provides a smart street lamp, including: a lamppost and at least one equipment box. At least one accommodating portion is placed in the lamppost; and the at least one equipment box is detachably placed in the accommodating portion. The equipment box is detachably mounted on the lamp pole for convenient transportation. Further, the equipment box can also be protected by the anti-theft security mechanism to enhance the anti-theft performance of the smart street lamp.

The above-mentioned embodiments are just used for exemplarily describing the principle and effects of the present disclosure instead of limiting the present disclosure. Those skilled in the art can make modifications or changes to the above-mentioned embodiments without going against the spirit and the range of the present disclosure. Therefore, all equivalent modifications or changes made by those who have common knowledge in the art without departing from the spirit and technical concept disclosed by the present disclosure shall be still covered by the claims of the present disclosure.

We claim:

1. A smart street lamp, comprising:

a lamppost, having at least one accommodating portion therein; and at least one equipment box, detachably placed in the accommodating portion, wherein the equipment box contains at least one box locking device, the box locking device comprises:

a lock body; and a locking mechanism connected in linkage with the lock body, for moving to a first position engaged with the lamppost to lock the equipment box in the accommodating portion when the lock body is in a locked state, or moving to a second position disengaged from the lamppost to unlock the equipment box and thus being taken away from the lamppost when the lock body is in an unlocked state, wherein the locking mechanism comprises a stopper that is movable to extend outside the equipment box to block against an inner wall of the lamppost, wherein the lock body comprises a mechanical lock and an electronic lock, and the locking mechanism is unlocked only when the mechanical lock and the electronic lock are both in an unlocked state, wherein the electronic lock is locked or unlocked according to an electronic control command, and the electronic control command is generated according to an identity verification result of a person operating the box locking device.

2. The smart street lamp according to claim 1, wherein a number of the equipment box is at least two, the equipment box includes:

an electric box to load a strong current circuit, and an electronic box to load a weak current circuit.

3. The smart street lamp according to claim 2, wherein the electric box comprises: one or a combination of an alternating current distribution circuit, a direct current distribution circuit, an alternating current and direct current conversion circuit, a light source driver, one or more sensors, an electrical wiring, and a fiber optic box.

4. The smart street lamp according to claim 3, wherein the one or more sensors comprise: one or a combination of a door state sensor, a temperature and humidity sensor, a smoke sensor, a water immersion sensor, and a lamppost state sensor.

5. The smart street lamp according to claim 2, wherein the electronic box comprises: one or a combination of a network communication module, a call extension module, a sensor access point module, one or more sensors, a controller, an electrical wiring, and a network wiring.

6. The smart street lamp according to claim 5, wherein the network communication module comprises: an Ethernet communication module and/or an Internet of Things communication module, the network communication module communicates with an external control platform, is controlled by the external control platform, and/or sends operating status information of the smart street lamp.

7. The smart street lamp according to claim 5, wherein the one or more sensors comprise: one or a combination of a door switch sensor, a temperature and humidity sensor, a smoke sensor, and a water immersion sensor.

8. The smart street lamp according to claim 1, wherein a number of the equipment box is one, and at least two sub-equipment boxes are placed in the equipment box, including:

an electric box to load a strong current circuit, and an electronic box to load a weak current circuit.

9. The smart street lamp according to claim 1, wherein the lock body comprises:

the mechanical lock, locking the equipment box to the lamppost when the mechanical lock is in a locked state, or unlocking the locking mechanism when the mechanical lock is in an unlocked state.

10. The smart street lamp according to claim 1, wherein the equipment box comprises: a box lock state sensor, an identity information collecting device and a controller placed at the box locking device;

the box lock state sensor detects signals generated by the box locking device when the box locking device is being operated;

the controller is communicably connected with the box lock state sensor and the identity information collecting device, the controller acquires identity information of a person performing the operation by the identity information collecting device when receiving the signal, wherein the identity information is configured to authenticate the identity of the person performing the operation, thereby generating the electronic control command sent to the electronic lock based on the identity verification result.

11. The smart street lamp according to claim 10, wherein the identity information collecting device comprises: one or more of an image collecting device, a sound collecting device, a password collecting device, a biological information collecting device, and a document information extracting device.

12. The smart street lamp according to claim 1, wherein a plurality of box locking devices is respectively located at at least two sides of the equipment box in different directions.

13. The smart street lamp according to claim 1, wherein the equipment box comprises: a box door and a box door locking device;

the box door locking device includes the electronic lock, the electronic lock locks or unlocks the box door according to the electronic control command, and the electronic control command is generated according to the identity verification result of the person operating the box door.

14. The smart street lamp according to claim 13, wherein the equipment box comprises:

a box door state sensor, for detecting signals generated by the box door when the box door is being operated;

an identity information collecting device; and a controller communicably connected with the box door state sensor and the identity information collecting device, the controller acquires identity information of a person performing the operation by the identity information collecting device when receiving the signal, wherein the identity information is configured to authenticate the identity of the person performing the operation, thereby generating the electronic control command sent to the electronic lock based on the identity verification result.

15. The smart street lamp according to claim 1, comprising: an alarm device, for performing an alarm when receiving an alarm command indicating that the identity verification result is a failure; wherein the alarm device includes: one or a combination of an audio player, a display screen of the smart street lamp, and a lighting source of the smart street lamp; and the alarm includes: one or a combination of playing an alarm audio through the audio player, playing an alarm image through the display screen, and performing lighting by the lighting source according to a preset alarm lighting parameter.

* * * * *